United States Patent [19]

Hungerford

[11] Patent Number: 4,869,157

[45] Date of Patent: Sep. 26, 1989

[54] MODULAR AIR BAR

[76] Inventor: John W. Hungerford, 2869 Hill Valley Dr., Escondido, Calif. 92025

[21] Appl. No.: 258,708

[22] Filed: Oct. 17, 1988

[51] Int. Cl.[4] ..... F24F 13/072

[52] U.S. Cl. ..... 98/40.16

[58] Field of Search ..... 98/40.14, 40.16, 40.17

[56] References Cited

U.S. PATENT DOCUMENTS

| | | | |
|---|---|---|---|
| 3,276,348 | 10/1966 | Kennedy | 98/40.16 |
| 3,302,550 | 2/1967 | Thomson | 98/40.16 |
| 3,411,425 | 11/1968 | Lambert | 98/40.16 |
| 3,444,801 | 5/1969 | Lambert | 98/40.16 |
| 3,601,033 | 8/1971 | Lambert | 98/40.16 |
| 3,760,709 | 9/1973 | Rachlin et al. | 98/40.16 |
| 3,919,928 | 11/1975 | Lambert | 98/40.16 |
| 4,316,407 | 2/1982 | Lambert | 98/40.16 |

FOREIGN PATENT DOCUMENTS

| | | | |
|---|---|---|---|
| 2518609 | 11/1976 | Fed. Rep. of Germany | 98/40.17 |
| 1361077 | 7/1974 | United Kingdom | 98/40.16 |

*Primary Examiner*—Harold Joyce

*Attorney, Agent, or Firm*—John M. Harrison

[57] ABSTRACT

A modular air bar for mounting in the ceiling system of a structure, which modular air bar is characterized by a pair of spaced air deflectors having curved, facing interior air channels and fitted with horizontally-shaped top and bottom spacers at each end. A pair of pattern controllers are laterally slidably mounted between the spacers and extend substantially throughout the length of the deflectors, in order to deflect air flowing through the modular air bar around the air channels and directionally distribute the air through an air slot between the deflectors, into the structure.

23 Claims, 2 Drawing Sheets

FIG. 1
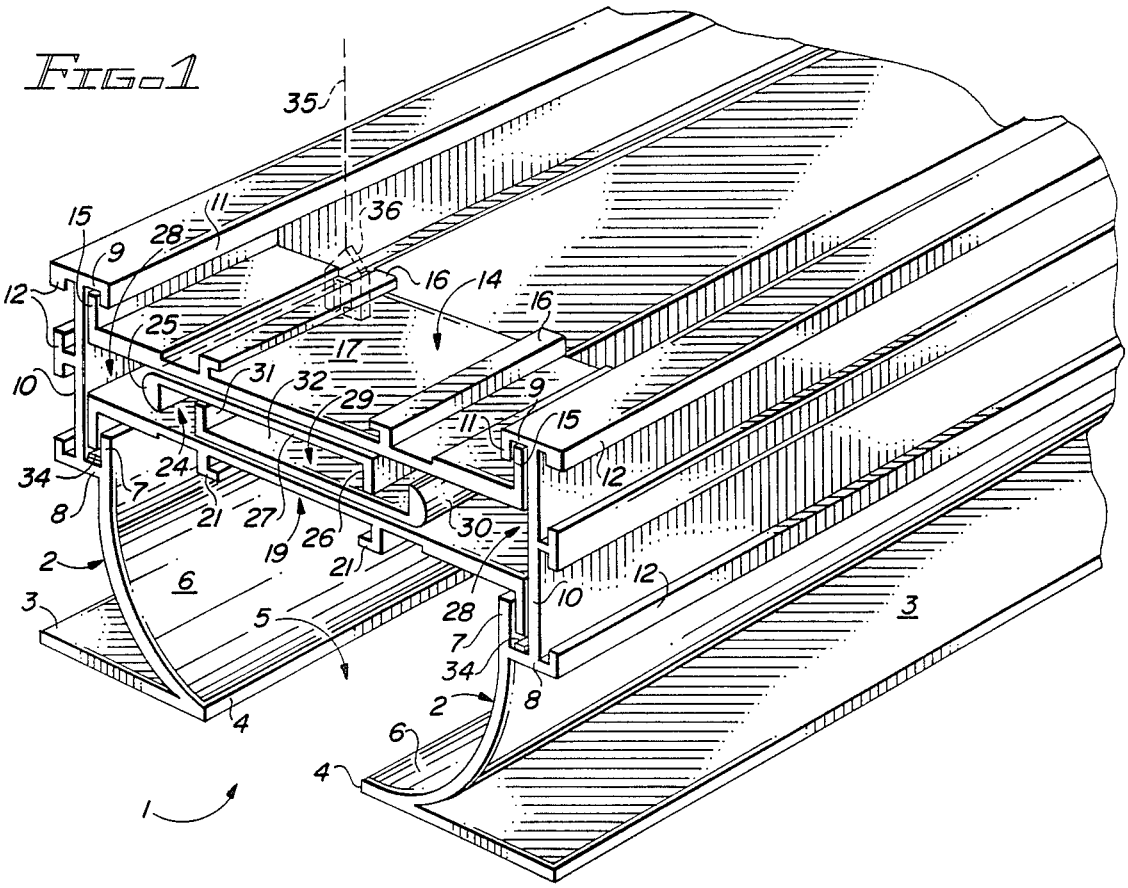
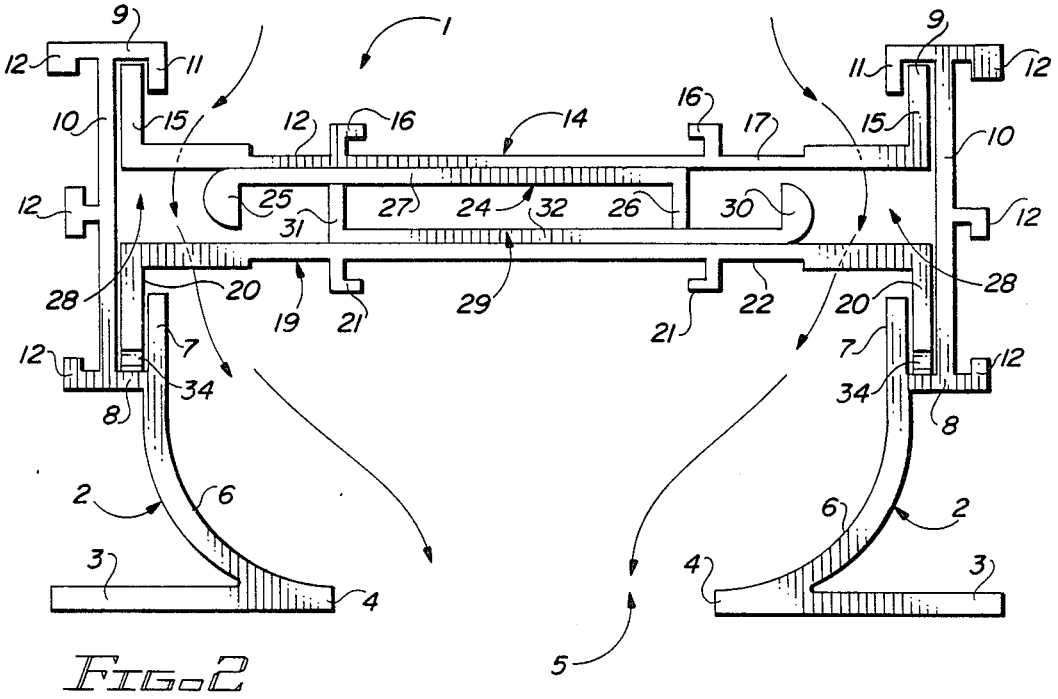
FIG. 2

MODULAR AIR BAR

BACKGROUND OF THE INVENTION

Field of the Invention

This invention relates to linear air diffusers and more particularly, to a self-supporting linear and modular air bar which serves to diffuse air in a selected pattern from the ceiling plenum of a structure. In a preferred embodiment of the invention the modular air bar is characterized by a pair of vertically-spaced deflectors connected by spacers at each end, which spacers slidably contain a pair of pattern controllers that extend along the length of the deflectors. The deflectors are fitted with at least one, and preferably two oppositely-disposed, curved air channels which terminate at a common air slot, in order to receive air from the plenum and direct the air according to the position of the slidably mounted pattern controllers, across the air channel or channels and through the air slot for directional diffusion into a room of the structure. In another preferred embodiment of the invention the spacers mounted in the ends of the deflectors are very narrow, in order to facilitate maximum air flow space along the length of the deflectors through the open passages created by laterally slidable manipulation of the respective pattern controllers, to directionally diffuse the air in a selected pattern into a room of the structure.

The use of suspended ceilings which extend downwardly from the permanent ceiling or roof of a building or structure has become widespread and esthetic considerations require that lighting fixtures, air conditioning outlets and like equipment and accessories be flush-mounted with the suspended ceiling. The space between the suspended and permanent ceiling is known as a "plenum" and usually receives air conditioning ducts, cables, piping and similar equipment. This type of construction presents numerous air handling problems, particularly in large structures, since changes in the number and location of personnel occupying such structures often require frequent and extensive adjustment of the air distribution mechanism, in order to effectively provide suitable air handling and conditioning. The older diffusion outlets which extend below the plane of a suspended ceiling are not normally used in modern construction designs and these older fixtures usually require highly specialized and sometimes expensive extrusions which greatly increase the cost of the air conditioning installation.

Suspended ceiling-integrated air distribution systems require the following components: a plenum, air chamber or chambers which is designed to collect air from a source of supply; an air diffuser assembly to distribute the air to a designated room or rooms in the structure; and a return air system for returning the air from the room or rooms to the source of supply. One technique for returning the air to the source of supply utilizes return air ducts located in the walls beneath the suspended ceiling and one or more air passages are normally provided to return the air to the supply source.

DESCRIPTION OF THE PRIOR ART

Many of the structures which have been proposed and used for air handling and distribution systems in connection with suspended ceilings suffer from a common disadvantage, in that they must be assembled at the suspended ceiling level. This method of assembly is difficult and usually results in a very high, and sometimes prohibitive, labor cost.

While the various air diffusing systems hereinafter disclosed in the prior art detail apparatus for creating a diffused air flow which operate successfully in many applications, there are some instances where a more focused air flow, as well as multiple streams of air from a single diffuser, are highly desirable. This is particularly true for air handling and conditioning systems that must operate in a structure characterized by a non-homogeneous temperature, such as a room that contains large glass windows which are exposed to either a significantly hotter or colder external environment. These windows tend to be highly conductive and due to the temperature gradient, may cause rapid alteration of the temperature and character of diffused air flow, thus preventing the room from attaining a uniform, comfortable temperature.

Various types of air distribution systems are known in the art. Typical of these systems is the "Air Distributor" detailed in W. W. Kennedy U.S. Pat. No. 3,276,348, dated Oct. 4, 1966. The air distributor apparatus detailed in this patent includes a device which is capable of discharging air into a room through a narrow outlet slot to diffusers, wherein the air stream flowing through the diffusers toward the outlet slot is deflected toward one side wall of the diffusers to impinge against a laterally-projecting flange defining one side of the outlet slot. The air stream is directed laterally by the flange to enter the room along the ceiling and the direction of the air stream may be varied to change the discharge pattern by adjusting the position of the deflector in the diffusers. Q. R. Thomson U.S. Pat. No. 3,302,550, dated Feb. 7, 1967, details another "Air Distributor". This air distributor includes laterally-spaced, parallel walls which define the sides of an elongated passage that is adapted to receive a flow of air. Each of the parallel walls are fitted with an inwardly-directed wall, the inner edges of which are spaced to form a slot for the passage of air. An intermediate wall is held in spaced relationship to the parallel walls and terminates above the inwardly-directed walls to form a support for a pair of individually vertically-slidable vane members. Supports for the vane members are also provided in vertically adjusted positions to bear against the inwardly-directed walls when in a fully lowered position, to prevent the flow of air through the slot. An "Air Diffusion Outlet With Laterally Adjustable Weir Control" is detailed in R. R. Lambert U.S. Pat. No. 3,411,425, dated Nov. 19, 1968. The diffuser is designed for use in suspended ceiling installations and includes a pair of parallel, spaced ceiling elements, each including an upstanding leg and bottom flanges, with the bottom flanges extending toward each other to define the diffuser outlet. Attachment means is also provided for interconnecting the pair of ceiling elements in a predetermined, spaced relationship, with the flanges spaced from each other and located in the ceiling plane, to form the diffuser outlet in the plane of the ceiling. A weir member is located between the legs of the ceiling elements and means for mounting the weir members in a plane parallel to the ceiling plane, but spaced above the flanges, is provided for lateral movement in the plane to vary the direction of air flow through the outlet. Robert R. Lambert U.S. Pat. No. 3,601,033, dated Aug. 24, 1971, details an "Air Diffuser Assembly with Integral Air Return". The assembly detailed in this patent includes a blanked-off channel mounted in a suspended ceiling integrated air distribution system, for blanking off a portion of the assembly from a continuous outlet of an air plenum chamber. A series of openings is also provided through the members for venting air from a room into an attic space above the ceiling and outside the plenum chamber. The openings are initially closed by removable knock-out plates and the openings may be selectively closed after once being opened, by plates removably mounted to the members, to selectively change the flow of air in the room. J. R. Rachlin et al U.S. Pat. No. 3,760,709, dated Sept. 25, 1973, details a "Ventilating Air Distributing Channel Spreader-Supporting Bracket". The apparatus includes a lower air flow channel section formed of two extruded metal bars having vertical webs, with hooks on the outside of the webs for defining ways, into which ways the wings of a bracket project, to hold the bars in a channel assembly. A clip integral with the bracket hooks over the top of a grid tee and has gripper confirmations to mate with a clip on the opposite side of the tee to align the channels. The air from the duct discharges through the opening between the webs and a spreader directs the air generally outwardly, as well as downwardly. In one aspect of the invention special brackets are provided to support the air flow spreader in a proper position. Robert R. Lambert U.S. Pat. No. 3,919,828, dated Nov. 18, 1975, details a "Suspended Ceiling and Air Distribution Arrangement". The apparatus includes a linear air plenum formed of duct board and carries a linear diffuser. The air plenum diffuser assembly is used with a ceiling having a series of main and cross-runner T-bars or similar ceiling support members. With the diffuser carried by the linear plenum, a slot is provided in the ceiling by an air track. Alternatively, the slot may be defined by an air bar which includes the diffuser elements, in which case the air plenum is provided with an air outlet collar which registers with the air bar. A number of these assemblies are connected end-to-end and arranged parallel to one of the cross or main runners and at right angles to the others. The lengths of the air plenum and the attached diffuser or air outlet collar are related to the module upon which the ceiling is designed and the diffuser or outlet collar length is less than the overall length of the air plenum.

Accordingly, it is an object of this invention to provide a new, improved and inexpensive air diffuser or bar which does not require a specially-designed plenum in the enclosure that receives the air diffuser or bar.

Another object of the invention is to provide a self-supporting, linear and modular air bar system which is simple to install, easy to operate and may be integrated into conventional ceiling support systems.

Yet another object of the invention is to provide a linear and modular air bar diffuser which may quickly and easily snapped onto or otherwise mounted in an existing plenum air handling system at a desired location without the necessity of extensive custom design work in the ceiling support system.

Still another object of this invention is to provide a linear and modular air bar having an improved, aesthetically pleasing, aerodynamic design which provides a high air volume at low pressure drop and low sound power levels, using an improved air slot design that facilitates a desirable "surface effect" in the air flow.

Another object of the invention is to provide a linear and modular air bar which is fitted with a pair of laterally slidable pattern controllers that facilitate comfortable air distribution in a room at reduced air volume with minimal air "dumping".

Yet another object of the invention is to provide a manually-adjustable air bar diffuser which serves as an "air trough" and may be totally integrated with a suspended ceiling system, since the device becomes a fixed component of the structure and does not require relocation with tenant improvement.

Another object of this invention is to provide a linear and modular air bar diffuser which is suitable in design for use as a transition between different types of ceilings in a structure and for side wall applications, as well as flat-mount applications in a ceiling support system.

Still another object of this invention is to provide a linear and modular air diffuser or air bar which is characterized by a pair of vertically-spaced deflectors having facing, curved air channels therein, spaced by an air slot, with a pair of spacers provided in each end of the deflectors and pattern controllers laterally slidably mounted between the spacers for deflecting air flowing through the air bar across the curved air channels and through the air slot in a direction which is determined by the position of the pattern controllers.

A still further object of the invention is to provide a modular air bar which is capable of being mounted in conventional ceiling support systems and directing air from a plenum into a room in a selected direction and volume.

SUMMARY OF THE INVENTION

These and other objects of the invention are provided in a new and improved linear and modular air bar designed for mounting in conventional ceiling support systems, which air bar includes a pair of spaced, curved deflectors that receive bottom and top end spacers containing laterally slidably-mounted pattern controllers, for directing the air through air passages defined by the deflectors and the pattern controllers, respectively, into a structure in a selected direction and volume. The curved deflectors and pattern controller design facilitate more efficiently handling a greater volume of air per linear foot than is possible using prior art air diffusers.

BRIEF DESCRIPTION OF THE DRAWINGS

The invention will be better understood by reference to the accompanying drawings, wherein:

FIG. 1 is a perspective view, partially in section, of a preferred embodiment of the modular air bar of this invention;

FIG. 2 is an end view of the modular air bar illustrated in FIG. 1; and

DESCRIPTION OF THE PREFERRED EMBODIMENTS

Figure 3:
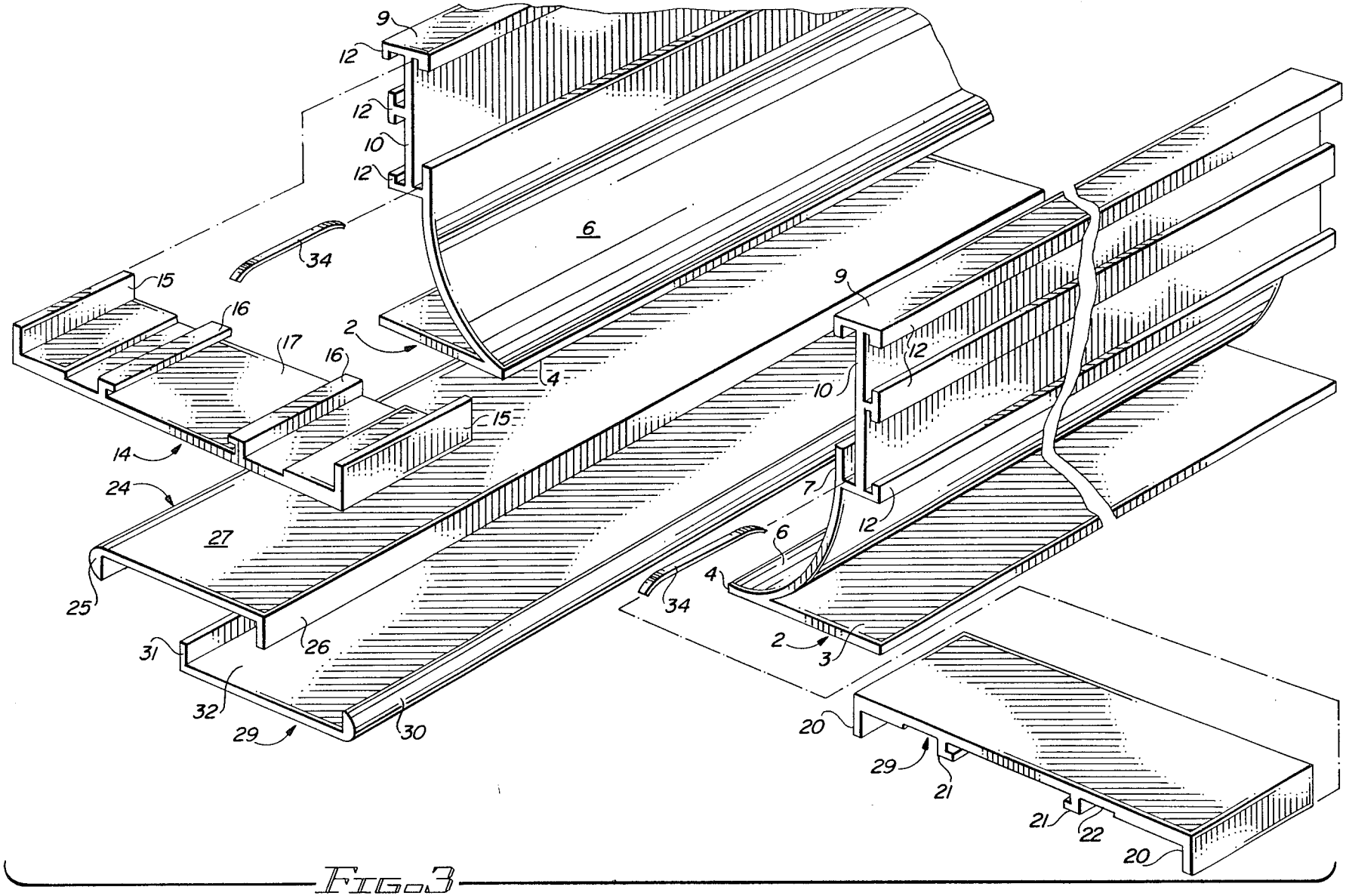
FIG. 3 is a perspective, exploded view of the modular air bar illustrated in FIGS. 1 and 2.

Referring to FIGS. 1–3 of the drawings, the modular air bar of this invention is generally illustrated by reference numeral 1 and includes a pair of vertically-spaced deflectors 2, each fitted with a horizontally oriented, outwardly-extending deflector base 3. Each deflector base 3 terminates along one edge in a base edge 4, which extends in parallel relationship with respect to the opposite base edge 4 to define an air slot 5. Each of the deflectors 2 is further provided with a curved air channel 6 which extends upwardly from the base edge 4, respectively, and terminates in an upward-standing air channel shoulder 7. A bottom spacer seat 8 is shaped in each of the deflectors 2 and extends outwardly of each air channel shoulder 7 and a top spacer seat 9 is located above and opposite the bottom spacer seat 8 and is separated therefrom and connected thereto by a spacer seat connector 10, respectively. Each spacer seat connector 10 further includes spaced, outwardly-extending connector flanges 12, as illustrated, in order to receive one or more clips (not illustrated) for engaging the connector flanges 12 and joining multiple units of the modular air bar 1 together in parallel relationship. A top spacer retainer 11 projects downwardly from the top spacer seat 9 opposite the top one of the connector flanges 12, respectively, and each bottom spacer seat 8 and top spacer seat 9 are designed to accommodate one of the parallel top spacer legs 15 and bottom spacer legs 20, respectively, of the top spacer 14 and the bottom spacer 19. The top spacer 14 is further characterized by a pair of spaced support flanges 16, which are upward-standing from a top spacer channel 17, and receive several hanger brackets 36, suspended by means of a hanger wire 35, one of which hanger brackets 36 and hanger wire 35 combination is illustrated in phantom in FIG. 1. The bottom spacer 19 further includes a pair of downwardly-extending bottom spacer flanges 21, connected to a bottom spacer channel 22 therein and the top spacer 14 and bottom spacer 19 are interchangeable in the modular air bar 1. A top pattern controller 24 is slidably seated in the space between the top spacer 14 and the bottom spacer 19 and is further characterized by a downwardly-extending top pattern controller head 25 and a downwardly-extending top pattern controller foot 26, spaced by and connected to a top pattern controller leg 27. A companion bottom pattern controller 29 is also fitted in the space between the top spacer 14 and the bottom spacer 19 in slidable contact with the bottom spacer 19 and the top pattern controller 24. Like the top pattern controller 24, the bottom pattern controller 29 is further characterized by a bottom controller leg 32, a bottom pattern controller foot 31 upwardly-extending from one end of the bottom controller leg 32 and an upwardly-extending bottom pattern controller head 30, connected to the opposite end of the bottom pattern controller leg 32. As illustrated in the drawings, the top pattern controller leg 27 slidably engages the top spacer 14 and the upward-standing bottom pattern controller foot 31, while the downwardly-extending top pattern controller foot 26 slidably engages the bottom spacer 19 and the corresponding bottom pattern controller leg 32. It will be appreciated from a consideration of FIG. 3 that the top pattern controller 24 and the bottom pattern controller 29 are laterally slidably disposed in the space between the top spacer 14 and the bottom spacer 19 along the length of the deflector 2, such that the top pattern controller head 25 can be manually slidably extended to the left to engage the left-hand spacer seat connector 10 and the bottom pattern controller head 30 can be manually slidably extended to the right to engage the right-hand spacer seat connector 10. This positioning of the top pattern controller 24 and the bottom pattern controller 29 substantially blocks the flow of air through the air passages 28 of the modular air bar 1, as hereinafter further described. It will be appreciated that the entire length of the top pattern controller 24 and the bottom pattern controller 29 are not illustrated in FIG. 1, for purposes of clarity.

Referring now to FIGS. 1 and 2 of the drawings, during operation of the modular air bar 1, air flows through the air passages 28 of the modular air bar 1 between the spacer seat connectors 10 and the respective top pattern controller head 25 and bottom pattern controller 30, throughout the length of the modular air bar 1, as illustrated by the arrows in FIG. 2. Accordingly, it will be appreciated that the path of air flow is maximum in the area between the respective spacer seat connectors 10 and the corresponding top pattern controller head 25 and bottom pattern controller head 30 when the top pattern controller 24 is fully retracted inwardly with respect to the bottom pattern controller 29. Conversely, extension of the top pattern controller head 25 and the bottom pattern controller head 30 across the air passages 28 to the respective spacer seat connectors 10, causes the top pattern controller leg 27 and the bottom pattern controller leg 32 to substantially block the air passages 28, since the respective top pattern controller leg 27 and bottom pattern controller leg 32 extend through the air passages 28, respectively.

Referring again to FIGS. 1–3 of the drawings, in a preferred embodiment of the invention a pair of spring clips 34 are fitted in the spaces between the air channel shoulders 7 and the spacer seat connectors 10, respectively, in order to receive the bottom spacer legs 20 and bias the top spacer 14 and the bottom spacer 19 into position against the top pattern controller 24 and the bottom pattern controller 29, respectively. This spring-loading of the top pattern controller 24 and the bottom pattern controller 29 serves to prevent inadvertent lateral slippage of the top pattern controller 24 with respect to the bottom pattern controller 29 and corresponding misadjustment of air flow through the air passage 28.

Referring again to the drawings, in operation, the modular air bar 1 is adjusted to control the flow of air through the respective air passages 28, as follows. Referring specifically to FIG. 2 of the drawings, if air flow through both of the spaced air passages 28 is desired, the top pattern controller 24 and bottom pattern controller 29 are manually slidably adjusted laterally with respect to each other between the top spacer 14 and the bottom spacer 19, such that the top pattern controller head 25 and the bottom pattern controller head 30 are spaced from the respective spacer seat connectors 10 to a desired extent. This adjustment partially opens the air passages 28 and allows air to flow through the modular air bar 1, as indicated by the arrows. Air flowing through the air passages 28 is directed to the air slot 5 by the oppositely-disposed, curved air channels 6 and the air is directed downwardly from the modular air bar 1 when the two streams of air meet at the air slot 5. As further illustrated in FIG. 2, when the bottom pattern controller head 30 is moved to the adjacent spacer seat connector 10 by shifting the bottom pattern controller 29 to the right, the right-hand air passage 28 is closed. Under these circumstances, air continues to flow through the left-hand air passage 28 and is directed through the air slot 5 at an angle, due to the curvature of the air channel 6 in the left-hand deflector 2. This action effects directional control of the air flow through the modular air bar 1 into a room or structure. The direction of this air flow can be reversed by opening the bottom pattern controller 29 and closing the top pattern controller 24 or shifting the bottom pattern controller 29 and the top pattern controller 24 in concert to the left, as viewed in FIG. 2, to facilitate air flow through the right-hand air passage 28. Accordingly, the volume of air flowing through either or both of the air passages 28 is controlled by slidably adjusting the top pattern controller 24 and the bottom pattern controller 29 inwardly and outwardly, as desired.

The components of the modular air bar 1 are typically constructed of extruded aluminum and it will be appreciated that the modular air bar 1 can be constructed to any desired dimensions and specifications for installation in an extended ceiling, plenum air handling system of substantially any design. Accordingly, it is understood that the modular air bar 1 can be installed in any desired spatial orientation, including modular side-by-side, interconnecting arrangement, parallel orientation or in a linear, end-to-end arrangement, in non-exclusive particular. The modular air bar 1 is usually suspended from the plenum ceiling by hanger wires 35 using connecting hanger brackets 36, as illustrated in FIG. 1, in the same manner as conventional suspended ceilings (not illustrated).

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A modular air bar for mounting in an air distribution system comprising a pair of air deflectors disposed in spaced, substantially parallel relationship, each of said air deflectors provided with concave arcuate air channels disposed in facing relationship, retainer means carried by said air deflectors in vertically spaced relationship, respectively, a top spacer and a bottom spacer and leg means provided in said top spacer and said bottom spacer, respectively, said leg means adapted for engagement with said retainer means and connecting said air deflectors and pattern controller means slidably disposed between said air deflectors adjacent to said top spacer and said bottom spacer for directionally adjusting the flow of air between said air deflectors and said pattern controller means along at least one of said arcuate air channels.

2. The modular air bar of claim 1 further comprising hanger attachment means provided on said air deflectors for securing hangers to said air deflectors and suspending said modular air bar in the air distribution system. means

3. The modular air bar of claim 1 wherein said pattern controller means further comprises a bottom pattern controller comprising an elongated bottom plate carried by said spacer means, said bottom plate extending substantially along the length of said air bar, a bottom plate foot upward-standing from one edge of said bottom plate and a bottom plate head upward-standing from the opposite edge of said bottom plate; and a top pattern controller comprising an elongated top plate carried by said spacer means, said top plate extending substantially along the length of said air bar in spaced, substantially parallel relationship with respect to said bottom plate, said top plate slidably engaging said bottom plate foot, a top plate foot extending downwardly from one edge of said top plate, said top plate foot slidably engaging said bottom plate, and a top plate head extending downwardly from the opposite edge of said top plate, whereby said top plate is spaced from said bottom plate by said bottom plate foot and said top plate foot and the flow of air is directionally channelled between said air deflectors responsive to slidable lateral adjustment of said bottom pattern controller and said top pattern controller.

4. The modular air bar of claim 3 further comprising retainer means carried by said air deflectors in vertically spaced relationship, said retainer means adapted to receive said spacer means and support said bottom pattern controller and said top pattern controller in vertically-spaced, substantially parallel relationship.

5. The modular air bar of claim 3 further comprising hanger attachment means provided on said air deflectors for securing hangers to said air deflectors and suspending said modular air bar in the air distribution system.

6. The modular air bar of claim 3 further comprising:

(a) retainer means carried by said air deflectors in vertically spaced relationship, said retainer means adapted to receive said spacer means and support said bottom pattern controller and said top pattern controller in vertically spaced, substantially parallel relationship; and (b) hanger attachment means provided on said air deflectors for securing hangers to said air deflectors and suspending said modular air bar in the air distribution system.

7. The modular air bar of claim 3 wherein said spacer means further comprises a top spacer and a bottom spacer disposed in substantially parallel relationship with respect to said top spacer and further comprising leg means provided in said top spacer and said bottom spacer, respectively, said leg means adapted for engagement with said retainer means and supporting said bottom pattern controller and said top pattern controller between said top spacer and said bottom spacer.

8. The modular air bar of claim 4 wherein said retainer means further comprises a top retainer and a bottom retainer provided in each of said air deflectors, said spacer means further comprises a top spacer and a bottom spacer disposed in substantially parallel relationship with respect to said top spacer and further comprising a top set of legs projecting upwardly from said top spacer for engaging said top retainer and a bottom set of legs projecting downwardly from said bottom spacer for engaging said bottom retainer for supporting said bottom pattern controller and said top pattern controller between said top spacer and said bottom spacer.

9. The modular air bar of claim 8 further comprising bias means inserted between said bottom set of legs and said bottom retainer, respectively, for biasing said bottom pattern controller and said top pattern controller between said bottom spacer and said top spacer.

10. A modular air bar for mounting in an air distribution system, comprising a pair of oppositely-disposed, spaced air deflectors having concave facing, arcuate air channels, a pair of substantially horizontally-disposed spacers carried by said air deflectors in spaced relationship and a pair of elongated pattern controller means slidably disposed between said spacers, said pattern controller means each extending substantially along the entire length of said air deflectors, whereby air is directed between said air deflectors and at least one of said pattern controller means along at least one of said arcuate air channels, responsive to slidable lateral manipulation of said pattern controller means between said spacers.

11. The modular air bar of claim 10 further comprising hanger attachment means provided on said air deflectors for securing hangers to said air deflectors and suspending said modular air bar in the air distribution system.

12. The modular air bar of claim 10 further comprising retainer means carried by said air deflectors in vertically spaced relationship, said retainer means adapted to receive said spacers in vertically spaced, substantially parallel relationship.

13. The modular air bar of claim 10 further comprising:

(a) hanger attachment means provided on said air deflectors for securing hangers to said air deflectors and suspending said modular air bar in the air distribution system; and (b) retainer means carried by said air deflectors in vertically spaced relationship, said retainer means adapted to receive said spacers in vertically spaced, substantially parallel relationship.

14. The modular air bar of claim 12 further comprising leg means provided in said spacers, respectively, said leg means adapted for engagement with said retainer means and wherein said pattern controller means is disposed between said spacers.

15. The modular air bar of claim 14 wherein said pattern controller means further comprises a bottom pattern controller comprising an elongated bottom plate extending substantially along the length of said air bar, a bottom plate foot upward-standing from one edge of said bottom plate and a bottom plate head upward-standing from the opposite edge of said bottom plate; and a top pattern controller comprising an elongated top plate extending substantially along the length of said air bar in spaced, substantially parallel relationship with respect to said bottom plate, said top plate slidably engaging said bottom plate foot, a top plate foot extending downwardly from one edge of said top plate, said top plate foot slidably engaging said bottom plate, and a top plate head extending downwardly from the opposite edge of said top plate, whereby said top plate is spaced from said bottom plate by said bottom plate foot and said top plate foot and the flow of air is directionally channelled between said air deflectors responsive to slidable lateral adjustment of said bottom pattern controller and said top pattern controller.

16. The modular air bar of claim 15 wherein said retainer means further comprises a top retainer and a bottom retainer provided in each of said air deflectors, said spacers further comprise a top spacer and a bottom spacer disposed in substantially parallel relationship with respect to said top spacer, said leg means are further characterized by a top set of legs projecting upwardly from said top spacer for engaging said top retainer and a bottom set of legs projecting downwardly from said bottom spacer for engaging said bottom retainer, and wherein said bottom plate slidably engages said top spacer and said top plate slidably engages said bottom spacer.

17. The modular air bar of claim 16 further comprising bias means inserted between said bottom set of legs and said bottom retainer, respectively, for biasing said bottom pattern controller and said top pattern controller between said bottom spacer and said top spacer.

18. A modular air bar for mounting in the air distribution system of a structure and directionally orienting an air flow into the structure, comprising a pair of oppositely-disposed, spaced air deflectors positioned in the air flow, said air deflectors having concave facing, arcuate air channels terminating in spaced relationship to define an air exit slot; a pair of substantially horizontally-disposed spacers carried by said air deflectors in spaced relationship and a pair of elongated pattern controllers slidably disposed between said spacers, said pattern controllers each extending substantially along the entire length of said air deflectors, whereby the air flow is directed between said air deflectors along at least one of said arcuate air channels and through said air exit slot into the structure, responsive to slidable lateral manipulation of said pattern controllers between said spacers with respect to said air deflectors.

19. The modular air bar of claim 18 further comprising:

(a) hanger attachment means provided on said air deflectors for securing hangers to said air deflectors and suspending said modular air bar in the air distribution system; and (b) retainer means carried by said air deflectors in vertically spaced relationship, said retainer means adapted to receive said spacers in vertically spaced, substantially parallel relationship.

20. The modular air bar of claim 19 further comprising leg means provided in said spacers, respectively, said leg means adapted for engagement with said retainer means for maintaining said spacers in substantially horizontally-disposed relationship with respect to each other.

21. The modular air bar of claim 20 wherein said pattern controllers are further characterized by a bottom pattern controller comprising an elongated bottom plate extending substantially along the length of said air bar, a bottom plate foot upward-standing from one edge of said bottom plate and a bottom plate head upward-standing from the opposite edge of said bottom plate; and a top pattern controller comprising an elongated top plate extending substantially along the length of said air bar in spaced, substantially parallel relationship with respect to said bottom plate, said top plate slidably engaging said bottom plate foot, a top plate foot extending downwardly from one edge of said top plate, said top plate foot slidably engaging said bottom plate, and a top plate head extending downwardly from the opposite edge of said top plate, whereby said top plate is spaced from said bottom plate by said bottom plate foot and said top plate foot and the flow of air is directionally channelled between said air deflectors responsive to slidable lateral adjustment of said bottom pattern controller and said top pattern controller.

22. The modular air bar of claim 21 wherein said retainer means further comprises a top retainer and a bottom retainer provided in each of said air deflectors, said spacers further comprise a top spacer and a bottom spacer disposed in substantially parallel relationship with respect to said top spacer, said leg means are further characterized by a top set of legs projecting upwardly from said top spacer for engaging said top retainer and a bottom set of legs projecting downwardly from said bottom spacer for engaging said bottom retainer, and wherein said bottom plate slidably engages said top spacer and said top plate slidably engages said bottom spacer.

23. The modular air bar of claim 22 further comprising bias means inserted between said bottom set of legs and said bottom retainer, respectively, for biasing said bottom pattern controller and said top pattern controller between said bottom spacer and said top spacer.

* * * * *